US005439116A

United States Patent [19]

Van Lierde et al.

[11] Patent Number: 5,439,116

[45] Date of Patent: Aug. 8, 1995

[54] PROCESS FOR THE RECOVERY OF MICAS BY FLOTATION AND MICAS THUS OBTAINED

[75] Inventors: Andre Van Lierde, Brussels, Belgium; Jean-Philippe Beuvelet, Plevin, France

[73] Assignee: Mircal, Paris, France

[21] Appl. No.: 190,552

[22] Filed: Feb. 2, 1994

[30] Foreign Application Priority Data

Feb. 4, 1993 [FR] France ..... 93 01221

[51] Int. Cl.[6] ..... B03D 1/02

[52] U.S. Cl. ..... 209/167; 209/166; 423/111; 423/328.3

[58] Field of Search ..... 209/166, 167; 252/61; 423/111, 118, 328.3

[56] References Cited

U.S. PATENT DOCUMENTS 2,132,902 10/1938 Lenher .
2,307,397 1/1943 Falconer .
2,337,118 12/1943 Lontz .
2,857,051 10/1958 Noblitt .
2,885,078 5/1959 Fenske .
3,009,570 11/1961 Lancaster .
3,214,018 10/1965 Neal .
3,278,028 10/1966 Millsaps .
3,329,265 7/1967 Browning .
3,804,243 4/1974 Yang ..... 209/166

FOREIGN PATENT DOCUMENTS 529433 5/1958 Canada .
557002 5/1958 Canada .
583809 9/1959 Canada .
0456565 11/1991 European Pat. Off. .

OTHER PUBLICATIONS

Chemical Abstracts, vol. 102, No. 2, abstract No. 10118h, Jan. 14, 1985.
Chemical Abstracts, vol. 80, No. 16, abstract No. 85862g, Apr. 22, 1974.
Chemical Abstracts, vol. 98, No. 18, Abstract No. 147267z, May 2, 1983.
Scandinavian Journal of Metallurgy, vol. 12, No. 3, 1983, pp. 117–120.

*Primary Examiner*—Thomas M. Lithgow
*Attorney, Agent, or Firm*—Jacobson, Price, Holman & Stern

[57] ABSTRACT

The invention relates to a process for the recovery of micas by flotation starting with slurried ore from which the fines have been optionally removed, comprising a stage of bringing the said slurry into contact with an appropriate cationic collector, followed by an actual flotation stage and recovery of the supernatant formed for subsequent treatment and optional rewashing, characterized in that it is carried out at a pH higher than 6 and in that the stage of bringing the said slurry into contact with the cationic collector is preceded by a stage of bringing the said slurry into contact with an activating agent chosen from soluble metal salts.

The invention also relates to the micas obtained by the process.

17 Claims, No Drawings

PROCESS FOR THE RECOVERY OF MICAS BY FLOTATION AND MICAS THUS OBTAINED

The invention relates to a process for the recovery of micas by flotation starting with slurried ore from which the fines have been optionally removed, comprising a stage of bringing the said slurry into contact with a suitable cationic collector, followed by an actual flotation stage and recovery of the supernatant formed for subsequent treatment and optional rewashing.

The invention also relates to the micas obtained by this process.

Micas are minerals which consist of a double silicate of aluminium and of another metal, for example sodium, potassium or magnesium, with, additionally traces of iron, particularly in the form of iron oxide (FeO).

Micas are employed in various industries as fillers in plastics, bituminous products and special cements.

The process of separation by flotation consists in suspending the ore in water and adding to the slurry obtained a collecting agent which will be deposited on one or more of the compounds constituting the ore and which, when a vigorous air stream is introduced, will enable the air bubbles to attach themselves around the said compounds, the said bubbles ensuring the levitation of the said compounds in the form of froth with the aid of a frothing agent. These compounds are then discharged and optionally reprocessed (rewashing).

The ores containing micas frequently also include calciferous materials such as calcite. One of the additional problems to be solved consists in separating the micas from these limestones because, in this case, the conventional flotation method at acidic pH cannot be employed.

Ores containing micas also frequently include sulphur-containing minerals such as iron sulphides and, in this case, one of the additional problems to be solved consists in separating the sulphur-containing minerals from the micas either by floating up the micas during the flotation or, conversely, by floating the sulphur-containing minerals, the micas then remaining at the bottom of the reaction vessel.

Within the scope of the present description the expression "flotation process" will be applied to the flotation process, from slurrying to the stage of bringing the air stream into contact with the slurry, whereas the expression "flotation stage" will be applied to the actual bringing of the air stream into contact with the said slurry.

A number of processes for recovering micas by flotation have already been proposed.

Adair et al. have described, in the periodical US Govt. Res. Develop. Rep. 1969, 69(16), 80, a process for the flotation of muscovite starting with Alabama ore based on schist and graphitic mica. After a preconcentration of the ground ore on a Humphrey spiral, the process of flotation of the mica, already purified to more than 89%, is ensured by bringing the slurry in an acidic medium into contact with a cationic collector, the purity of the mica obtained being of the order of 98%.

Nevertheless, this process requires, on the one hand, a preliminary grinding followed by a stage of preconcentration and, on the other hand, a stage of acidification of the slurry. In fact, normally, the ores containing micas are naturally at basic pH.

Tiunof et al., CA98(18):147267z, describe a process for the recovery of muscovite from ore containing it by flotation in an alkaline medium in the presence of a cationic collector and addition of hydroxamic acid to the medium as a muscovite-activating agent. This process requires the introduction of sodium carbonate in order to buffer the medium because of the addition of hydroxamic acid.

In CA102(2):10118h, Gershenkop has described a process for mica flotation resulting in a muscovite whose purity is higher than 95%, in the presence of a cationic collector and of a frothing agent, the said flotation being activated by the addition of sodium fluorosilicate.

In the journal Scand. J. Metall. 12(3), 117–20 Bolin et al. describe a mica flotation process consisting in grinding pegmatite, removing the fines and floating the slurry at an acidic pH (approximately 3–4) in the presence of a diamine collector. It is indicated that a better selectivity is observed when the mica flotation is carried out in the presence of iron ions. Nevertheless, this process requires the slurry, which is normally in a basic medium, bearing in mind the origin of the ores, to be placed in a relatively highly acidic phase.

In the light of the prior art discussed above, one of the objectives of the present invention is to propose an improved process for the recovery of micas by flotation.

Another objective of the present invention is to propose a process for the recovery of micas which does not require the substantial modification of the pH of the slurry as obtained by mixing the natural ore with water.

Another particular objective of the present invention is to propose a process for the recovery of micas from ore containing calcite.

In this case it is impossible to use the conventional method of mica flotation at acidic pH$\leqq$4 because calcite is attacked in an acidic medium, and this would result in a considerable and costly consumption of acid. The fact that the process according to the invention can be performed at natural (and thus basic) pH represents an important advantage in the case of the ores containing calcite.

Another objective of the present invention is to propose a process for the recovery of micas, especially phlogopite, whose purity is at least 95%.

Other objectives of the present invention will appear in the light of the description below.

The process according to the invention is characterized in that it is used at a pH higher than 6 and in that the stage of bringing the said slurry into contact with the cationic collector is preceded by a stage of bringing the said slurry into contact with an activating agent chosen from soluble metal salts.

In general, micas are double silicates of aluminium and of another metal (sodium, potassium or magnesium) with traces of iron. Among the micas which are lean in iron there may be mentioned phlogopite and muscovite, which are micas containing between 0 and 5% of $Fe_2O_3$, and biotite, which is a mica rich in iron (up to 13% $Fe_2O_3$).

Although the process according to the invention is not restricted to a particular abovementioned form of mica, it is nevertheless particularly suitable for the recovery of micas which are lean in iron, such as muscovite and, preferably, phlogopite.

The process is advantageously used for the treatment of ores containing calcite generally as between 5 and 20% by weight, but capable of reaching 50%.

Also preferably, the process is used for the treatment of ores containing iron sulphides and oxides, it being possible for this proportion to be between 0 and 10%, but capable of ranging up to 30% in some cases.

The essential characteristics of an ore which may be particularly suitable within the scope of the process according to the invention are given below.

| | |
|---|---|
| pyroxene | 45% |
| feldspar | 24% |
| quartz | 10% |
| calcite | 10% |
| mica | 5% |
| iron sulphides and oxides | 5% |
| graphite | 1% |

In general, the fines must be separated off after the slurrying and before beginning the introduction of the various ingredients, preceding the actual flotation stage.

These fines which are depleted in mica generally perturb any flotation with the aid of a cationic collector, both in respect of selectivity and of reactant consumption.

Depending on circumstances, it would be desirable to remove the fines whose particle size is smaller than a value within a range extending from 10 to 100 micrometres.

In technical parlance this removal of the fines is called desliming. This desliming operation may, of course, be performed before the slurrying although from an industrial viewpoint this solution is not desirable.

As already indicated above in the discussion of the prior art, in its principle, the flotation operation requires the materials to be recovered as supernatants, normally in the form of froth, to be used in combination with a collector which makes its surface hydrophobic, enabling the binding of the air bubbles ensuring the floating of the said material.

In the case of the process according to the invention, which is used at a neutral or basic pH, although it is still possible at a weakly acidic pH (between 6 and 7), the collector is a cationic collector, that is to say that it contains anion acceptor groups such as, for example, $NH_4^+$ groups. The cationic collectors will therefore be chosen, in a known manner, from amines containing a hydrophobic chain, such as linear $C_{18}$ amines.

Within the scope of the present invention the term "stage", for example "stage of bringing the said slurry into contact with an appropriate cationic collector", generally implies that an aging period is provided so that the various ingredients can perform the function which is attributed to them. The term "flotation stage" does not, exceptionally, imply this aging period, insofar as the flotation by definition involves bringing the slurry into contact with the air stream for a certain period.

The process is preferably used without the pH of the subsequent slurry being modified in relation to the natural pH. In general, this pH is basic and normally varies between 9 and 11. An additional advantage of the invention is therefore involved, of avoiding an additional stage of pH modification, since the pH of flotation is the natural pH.

Preferably, therefore, the process according to the invention is carried out at a pH which is higher than 8, advantageously between 9 and 11.

Among the activating agents which are suitable for the present invention there will be mentioned metals chosen from lead, copper, silver and mercury.

These metals are used in combination with salts which are preferably chosen from acetates, chlorides and nitrates.

50 to 1,000 g of activating agents are preferably brought into contact per ton of ore, advantageously from 100 to 600 g.

The ores containing micas also frequently contain sulphur-containing minerals such as iron sulphides (FeS or $FeS_2$).

One objective of the present invention is to make it possible to separate, on the one hand, the said sulphur-containing minerals and, on the other hand, the micas. The micas are recovered in the supernatant in the form of froth, while the sulphur-containing minerals fall to the bottom of the vessel and can thus be removed. In order to improve this separation, it has been found that it is very advantageous to introduce, during the stage of bringing the slurry into contact with the activating agent, an agent which depresses iron sulphides, such as sodium or potassium cyanide, sodium sulphites or sulphur dioxide. Among these iron sulphide-depressants preference will be given to sodium cyanide. It is obvious that in this case the process according to the invention cannot be used industrially at an acidic pH for safety reasons.

The weight ratio of the activating agent to the depressing agent is preferably between 0.1 and 50, advantageously 0.5 and 30.

In a known manner, during the stage of bringing the said slurry into contact with a cationic collector, this collector is used in combination with a frothing agent such as pine oil and an agent which makes it possible to control the formation of this froth, such as light fuel oil. During this stage of bringing into contact with a cationic collector the following composition is preferably employed:

50 to 1,500 g of cationic collector per ton of ore, 5 to 100 g of frothing agents per ton of ore, 5 to 100 g of antifoam per ton of ore.

A person skilled in the art will understand that these three ingredients can be added either simultaneously or following one another.

In order to improve the performance of the process further it is often preferable to precede the stage of bringing the slurry into contact with the activating agent (optionally used in combination with the depressing agent), with an additional stage in which the slurry is brought into contact with a dispersing agent, especially sodium silicate, and optionally with a calcite-depressing agent, especially Cataflot P40 ®.

This flotation process which is also known by the name of a "roughing" operation, may be optionally followed by one or more rewashing operations, characterized in that the supernatant in the form of froth formed is recovered and transferred to a vessel where the various stages of the roughing operation which are described above are reproduced optionally with the various variants with the exception of the stage of removal of fines and the optional exception of the introduction of the frothing agent and the antifoam agent. A person skilled in the art will be capable of assessing the advantage or otherwise of introducing such frothing and antifoam agents, depending on the conditions.

These rewashing operations may be recommenced a number of times. The process according to the invention will be preferably characterized in that, after the roughing operation, three rewashing operations are performed, resulting in micas whose purity is higher than 95%.

One of the prominent features that the invention displays—although in its most general aspect it is not limited thereto—is the process of recovery of phlogopite by flotation using a cationic collector, especially an amine, after activation of the slurry with the aid of lead nitrate, resulting in a phlogopite of an exceptional purity in addition to the advantages linked with the use of the process.

Thus, according to a preferred alternative form, the invention relates to a process for the recovery of phlogopite from ore containing it, which additionally exhibits the following characteristics:

5 to 50%, preferably 5 to 25%, of calcite, 0 to 30%, preferably 0 to 10%, of iron sulphides and/or oxides, characterized by the following stages:

a) the slurried ore is separated from the fines whose particle size is less than a value of between 10 and 100 micrometres, b) the slurry obtained is brought into contact with a dispersing agent, especially sodium silicate, and optionally with a calcite-depressing agent, especially Cataflot P40®, c) the slurry obtained in stage b) is brought into contact with an activating agent chosen from soluble lead salts, used in combination with a depressing agent for sulphides, d) the slurry obtained in stage c) is brought into contact with a cationic collector used in combination, optionally with a frothing agent and an antifoam, e) the slurry obtained in stage d) is subjected to a flotation stage and the supernatant is recovered, the said process being operated at natural pH.

This process is called "roughing".

Obviously, any of the alternative forms and explanations indicated above apply to this preferred alternative form. In order to improve the quality of the phlogopite further it is advantageous to perform subsequent rewashing operations.

The roughing process is consequently advantageously followed by one or more rewashing operations consisting in that the supernatant obtained previously is recovered and transferred to a vessel where the various stages are reproduced, with the exception of the stage of removal of fines and the optional exception of the introduction of the frothing agent and of the antifoam.

It is also possible to perform a magnetic separation of the concentrate obtained by the process according to the invention in order to lower the iron content of the mica. This additional stage may be replaced by a screening operation.

The invention also relates to the mica concentrates obtained with the aid of this process, and preferably the phlogopite concentrates with a purity of at least 95%.

The phlogopite obtained has a greatly improved $K_2O$ content (of the order of or higher than 9%) and has, for example, the following average characteristics:

$K_2O$=9.85%

MgO=21.1%

Fe=4.8%

$Na_2O$=0.2%

$TiO_2$=2.9% pyrrhotite=0.5% calcite=0.5% calcium felspar=2.2% sodium felspar=1.5% phlogopite=95.3%

The invention is now illustrated by the example below.

EXAMPLE 2,000 g of ores originating from a Stratmin company Canadian mine situated in Quebec, the composition of which is as follows:

| | |
|---|---|
| % CaO | 12.93 |
| % FeO | 3.75 |
| % MgO | 6.09 |
| % S | 1.82 |
| % $CO_2$ | 5.30 |
| % $Na_2O$ | 2.27 |
| % $K_2O$ | 2.24 |

the potassium oxide making it possible to assess the mica purity of the ore, are treated as follows:

After dilution of the ore with an appropriate quantity of water in order to obtain a slurry, an operation of removal of the fines with a particle size of less than 63 micrometres makes it possible to remove 12.7% by weight of the ore introduced. This operation is called "desliming" in technical parlance.

In a second stage 1 g of sodiumsilicate ($Na_2SiO_3$) is added, acting as a dispersant and depressant for quartz, together with 0.3 g of a depressant for calcite and the calciferous minerals such as anortite.

The slurry obtained is aged for 10 min.

In a third stage 0.2 g of sodium cyanide, which is a depressant for iron sulphides ($FeS_2$, FeS) is added first of all, followed by 0.6 g of lead nitrate ($Pb(NO_3)_2$), which is an activator for the micas, as has been found according to the present invention.

The slurry thus obtained is aged for 5 min.

In a fourth stage 0.8 g of a $C_{18}$ amine collector is added together with 0.07 g of a mixture of light fuel oil+pine oil in a weight ratio of 1/1. This slurry is aged for 2 min.

The pH in stages 1, 2 and 3 is 10.4, while in the fourth stage it is 10.3.

The slurry thus obtained is subjected to the actual flotation stage by introducing a vigorous air stream resulting, on the one hand, in the flotation of a froth and, on the other hand, the sedimentation of tailings.

80.4% by weight of the starting ore, that is 1.608 kg is recovered in the form of tailings and 6.9% by weight of the starting ore, that is 138 g in the form of froth.

The tailings have a potassium oxide content of 1.77%, whereas the supernatant has a content of 7.81%.

This operation, called a roughing operation, is followed by three rewashing stages which make it possible to improve the mica purity of the ore recovered.

The first rewashing stage consists in reproducing the roughing stage by adding, respectively, 0.1 g of sodium silicate and $7.5\times10^{-2}$ g of depressant for the calciferous minerals, in aging the slurry obtained for 10 min and then adding firstly $4\times10^{-2}$ g of sodium cyanide and then $5\times10^{-2}$ g of lead nitrate and aging the slurry obtained for 5 min.

$5\times10^{-2}$ g of $C_{18}$ amines is then added to the slurry as collector. The slurry is then aged for 2 min. All the above rewashing operations were performed at pH 10.4.

The said slurry is then subjected to a flotation stage for 1.25 min, which results in the recovery of a froth constituting 5.1% of the ore introduced, that is 102 g, whose potassium oxide content is 9.5% and in the recovery of a tailing which has settled, which constitutes 1.8% of the ore introduced and whose potassium oxide content is 3.3%.

This first operation is followed by a second rewashing operation repeating in succession the same stages as those described above, using the following quantities of the various ingredients:

sodium silicate $4\times10^{-2}$ g,
depressant for the calciferous minerals $3\times10^{-2}$ g,
sodium cyanide $2\times10^{-2}$ g,
lead nitrate $2\times10^{-2}$ g,
$C_{18}$ amine collector $1.02\times10^{-3}$ g.

The pH of the slurry in this operation is 10.3.

The flotation period, on the other hand, is reduced to 1 min.

A froth is thus obtained constituting 4.3% of the weight of the ore introduced (86 g), whose potassium oxide content is 9.94%, and a settled tailing is also recovered constituting 0.8% of the ore introduced (16 g), whose potassium oxide content is 7.09%.

This second washing operation is followed by a third operation, similar to the second one, apart from the concentration of the various ingredients, which is as follows:

sodium silicate $4\times10^{-2}$ g,
depressant for the calciferous minerals $2\times10^{-2}$ g,
sodium cyanide $2\times10^{-2}$ g,
lead nitrate $2\times10^{-2}$ g,
$C_{18}$ amine collector $1\times10^{-2}$ g.

The supernatant obtained as froth constitutes 3.6% by weight of the ore introduced, that is 72 g, whose potassium oxide content is 10.04%. 14 g of tailings are additionally recovered, whose potassium oxide content is 9.34%.

The potassium oxide yield is 16.6%.

The composition of the micas obtained after the third rewashing operation is given below:

| | |
|---|---|
| $K_2O$ | 10.04% |
| $Na_2O$ | 0.35% |
| CaO | 0.43% |
| MgO | 19.19% |
| Fe | 3.75% |
| S | 0.14% |
| $CO_2$ | 0.19% |
| Ti | 1.36% |

COMPARATIVE EXAMPLE

A 1,000-g sample whose potassium oxide content is 2.2% is slurried with the appropriate quantity of water and is then subjected to a desliming operation to remove the fines whose particle size is less than 63 micrometres.

These fines constitute 11.6% by weight of the ore introduced, that is 116 g.

0.1 and then 0.05 g of $C_{18}$ primary amine are added to the slurry and then, in two lots, 0.02 g of MIBC and 0.1 g of light fuel oil. The pH of the slurry is then 9.9. After 2 min of aging, flotation is carried out for 0.75 min and a supernatant is obtained as a froth constituting 1.9% of the ore introduced, that is 19 g, whose potassium oxide content is 2.33.

It is therefore found that, in comparison with the preceding example, the roughing operation results in an increase in the potassium oxide content by a factor of less than 1.1, whereas it is greater than 3.5 in the case where lead nitrate is added.

When 0.1 g of lead nitrate is added in a second operation and when, after aging for 5 minutes, the same stages as above are performed with the following quantities:

| | |
|---|---|
| primary amine | 0.1 g |
| MIBC | 0.1 g |
| light fuel | 0.1 g |

the pH being 9.7, and when the flotation is carried out for 1 min after aging for 2 min, an ore is obtained whose potassium oxide content is 3.29%.

After another operation during which lead nitrate is added again, an ore is collected in the froth whose $K_2O$ content is 5.45%.

These results clearly show the efficacious and beneficial effect of lead nitrate as activator for micas, particularly on phlogopite.

We claim:

1. A process for the recovery of micas by flotation from slurried ores containing micas from which the fines have been optionally removed, the process comprising a stage of bringing said slurry into contact with a cationic collector, subjecting said slurry to a flotation stage to form a supernatant containing said micas, and recovering said supernatant for subsequent treatment and optional rewashing, said process being carried out at a pH higher than 6, said stage of bringing the said slurry into contact with said cationic collector being preceded by a stage of bringing said slurry into contact with an activating agent selected from the group consisting of the soluble metal salts of lead, copper, silver and mercury.

2. Process according to claim 1, wherein the pH is higher than 8.

3. Process according to claim 1, wherein 50 to 1,000 g of activating agent is brought into contact with said slurry per ton of ore.

4. Process according to claim 1, wherein the salts are selected from the group consisting of acetates, chlorides and nitrates.

5. Process according to claim 1, wherein during the stage of bringing the slurry into contact with the activating agent an agent for depressing iron sulphides is also added.

6. Process according to claim 5 wherein the depressing agent is selected from the group consisting of sodium cyanide, potassium cyanide, sodium sulphites and sulphur dioxide.

7. Process according to claim 6, wherein the weight ratio of the activating agent to the depressing agent is between 0.5 and 50.

8. Process according to claim 1, wherein the collector is used in combination with a frothing agent and an antifoam.

9. Process according to claim 8, wherein the following are brought into contact with the slurry:

50 to 1,500 g of cationic collector per ton of ore,
5 to 100 g of frothing agent per ton of ore, and
5 to 100 g of antifoam per ton of ore.

10. Process according to claim 1, wherein the said stage of bringing the slurry into contact with the activating agent is preceded by bringing the said slurry into contact with a dispersing agent, and optionally with a calcite-depressing agent.

11. Process according to claim 10, wherein the dispersing agent is sodium silicate.

12. Process for the recovery of phlogopite from an ore containing said phlogopite which additionally has the following characteristics:

5 to 50% of calcite, and 0 to 30% of iron sulphides and/or oxides, comprising the following stages:

a) slurrying the ore in water and separating the slurried ore from the fines whose particle size is less than between 10 and 100 micrometers, b) bringing the slurry obtained from stage a) into contact with a dispersing agent, and optionally with a calcite-depressing agent, c) bringing the slurry obtained in stage b) into contact with an activating agent selected from the group consisting of soluble lead salts, used in combination with a depressing agent for sulphides, d) bringing the slurry obtained in stage c) into contact with a cationic collector optionally used in combination with a frothing agent and an antifoam, and e) subjecting the slurry obtained in stage d) to a flotation stage and recovering the supernatant containing the phlogopite.

13. Process according to claim 12, wherein the process further includes one or more rewashing operations consisting in that the recovered supernatant is transferred into a vessel where the various stages are reproduced, with the exception of the stage of removal of fines and with the optional exception of the introduction of the frothing agent and of the antifoam.

14. Process according to claim 12, wherein the ore has the following characteristics:

5–20% of calcite, and 0 to 10% of iron sulphides and/or oxides, and wherein the dispersing agent is sodium silicate.

15. Mica concentrate obtained by a process of bringing slurried ores containing micas from which the fines have been optionally removed into contact with a cationic collector, subjecting said slurry to a flotation stage to form a supernatant containing said micas, and recovering said supernatant for subsequent treatment and optional rewashing, said process being carried out at a pH higher than 6, said stage of bringing the said slurry into contact with said cationic collector being preceded by a stage of bringing said slurry into contact with an activating agent selected from the group consisting of the soluble metal salts of lead, copper, silver and mercury.

16. Phlogopite concentrate of purity higher than 95% obtained by a process comprising the following stages;

a) slurrying ore containing phlogopite, 5 to 50% calcite and 0 to 30% iron sulphides and/or oxides in water and separating the slurried ore from the fines whose particle size is less than between 10 and 100 micrometers, b) bringing the slurry obtained from stages a) into contact with a dispersing agent, and optionally with a calcite-depressing agent, c) bringing the slurry obtained in stage b) into contact with an activating agent selected from the group consisting of soluble lead salts, used in combination with a depressing agent for sulphides, d) bringing the slurry obtained in stage c) into contact with a cationic collector optionally used in combination with a frothing agent and an antifoam, and e) subjecting the slurry obtained in stage d) to a flotation stage and recovering the supernatant containing the phlogopite.

17. Phlogopite according to claim 16, of purity equal to at least 95% and additionally having a $K_2O$ content of the order of or higher than 9%.

* * * * *